US009181771B2

(12) United States Patent
Corre et al.

(10) Patent No.: US 9,181,771 B2
(45) Date of Patent: Nov. 10, 2015

(54) PACKER ASSEMBLY WITH ENHANCED SEALING LAYER SHAPE

(71) Applicant: Schlumberger Technology Corporation, Sugar Land, TX (US)

(72) Inventors: Pierre-Yves Corre, Eu (FR); Jean-Louis Pessin, Amiens (FR); Julian Pop, Houston, TX (US); Stéphane Metayer, Abbeville (FR); Stephen Yeldell, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 412 days.

(21) Appl. No.: 13/645,875

(22) Filed: Oct. 5, 2012

(65) Prior Publication Data

US 2014/0096979 A1 Apr. 10, 2014

(51) Int. Cl.
*E21B 33/127* (2006.01)
*E21B 49/08* (2006.01)

(52) U.S. Cl.
CPC ..... *E21B 33/127* (2013.01); *E21B 49/082* (2013.01)

(58) Field of Classification Search
CPC ..... E21B 49/08; E21B 49/081; E21B 49/10; E21B 33/127; E21B 33/1277
See application file for complete search history.

(56) References Cited

U.S. PATENT DOCUMENTS 2,581,070 A * 1/1952 Blood ..... 166/100
5,353,871 A 10/1994 Eslinger et al.
5,390,738 A 2/1995 Eslinger et al.
5,439,053 A 8/1995 Eslinger et al.
5,507,341 A 4/1996 Eslinger et al.
5,549,159 A 8/1996 Shwe et al.
5,613,555 A 3/1997 Sorem et al.
7,510,015 B2 3/2009 Corre et al.
7,699,124 B2 * 4/2010 Corre et al. ..... 175/60
7,823,636 B2 11/2010 Lucas
7,874,356 B2 * 1/2011 Corre et al. ..... 166/187
8,091,634 B2 * 1/2012 Corre et al. ..... 166/250.17
8,113,293 B2 * 2/2012 Corre ..... 166/387
2007/0039731 A1 2/2007 Fox et al.
2007/0144734 A1 6/2007 Xu et al.
2009/0159278 A1 * 6/2009 Corre et al. ..... 166/264
2009/0211756 A1 * 8/2009 Goodwin et al. ..... 166/264
2009/0301635 A1 * 12/2009 Corre et al. ..... 156/84
2009/0301715 A1 * 12/2009 Corre et al. ..... 166/250.17
2009/0308604 A1 * 12/2009 Corre et al. ..... 166/250.17
2010/0071898 A1 3/2010 Corre
2010/0122812 A1 * 5/2010 Corre et al. ..... 166/250.01

(Continued)

OTHER PUBLICATIONS

International Search Report and the Written Opinion for International Application No. PCT/US2013/063370 dated Jan. 17, 2014.

*Primary Examiner* — Blake Michener
(74) *Attorney, Agent, or Firm* — Kenneth Kincaid; Cathy Hewitt

(57) ABSTRACT

A packer assembly with an enhanced sealing layer is provided. The packer assembly may have an outer bladder with drains. The packer assembly may further have an inflatable inner packer disposed inside the outer bladder such that inflation of the inner packer causes the outer bladder to expand. End pieces may be coupled to the inner bladder and the outer bladder, and flowlines may be in fluid communication with the drains and the end pieces. A piston ring may reinforce the packer assembly. The piston ring may have three or more passive pistons which expand with the packer assembly during testing.

19 Claims, 7 Drawing Sheets

(56) References Cited

U.S. PATENT DOCUMENTS

| | | | | |
|---|---|---|---|---|
| 2010/0122822 | A1 | 5/2010 | Corre et al. | |
| 2010/0294516 | A1 | 11/2010 | Corre et al. | |
| 2010/0319912 | A1* | 12/2010 | Pop et al. | 166/264 |
| 2011/0067860 | A1 | 3/2011 | Corre et al. | |
| 2011/0272150 | A1* | 11/2011 | Ives et al. | 166/264 |
| 2011/0277999 | A1* | 11/2011 | Corre et al. | 166/264 |
| 2013/0341016 | A1* | 12/2013 | Corre et al. | 166/264 |
| 2014/0008061 | A1* | 1/2014 | Corre et al. | 166/264 |

* cited by examiner

PACKER ASSEMBLY WITH ENHANCED SEALING LAYER SHAPE

CROSS-REFERENCE TO RELATED APPLICATIONS

None.

FIELD OF THE INVENTION

The present disclosure generally relates to downhole tools. More specifically, the present disclosure relates to a packer with an enhanced sealing layer shape.

BACKGROUND INFORMATION

For successful oil and gas exploration, information about the subsurface formations that are penetrated by a wellbore is necessary. Measurements are essential to predicting the production capacity and production lifetime of a subsurface formation. Collection and sampling of underground fluids contained in subterranean formations is well known. In the petroleum exploration and recovery industries, for example, samples of formation fluids are collected and analyzed for various purposes, such as to determine the existence, composition and producibility of subterranean hydrocarbon fluid reservoirs. This aspect of the exploration and recovery process is crucial to develop exploitation strategies and impacts significant financial expenditures and savings.

Samples of formation fluid, also known as reservoir fluid, are typically collected as early as possible in the life of a reservoir for analysis at the surface and more particularly, in specialized laboratories. The information that such analysis provides is vital in the planning and development of hydrocarbon reservoirs, as well as in the assessment of the capacity and performance of a reservoir.

One technique for sampling formation fluid from subterranean formations and conducting formation tests often includes one or more inflatable packer assemblies or packers (e.g., straddle packers) to hydraulically isolate or seal a section of a wellbore or borehole that penetrates a formation to be tested or sampled. Such inflatable packer assemblies typically include a flexible packer element made from an elastomeric material that is reinforced with metal slats or cables. However, due to the harsh conditions (e.g., high temperatures) within many boreholes, the elasticity and mechanical strength of the elastomeric material of the packer element may become significantly compromised. Thus, a packer may be inflated to seal against a portion of the borehole and may retain a relatively large outside diameter after the inflation pressure has been released. In some cases, the outside diameter of the previously inflated packer may be large enough to prevent the downhole tool to which it is attached from being removed from the borehole, thereby resulting in a costly well repair and/or tool recovery operation.

Additionally, in applications where an inflatable packer is used with a downhole tool deployed via a drill string, a packer element may inadvertently expand as a result of the rotation and become wedged in the borehole. This may cause the packer to become damaged or may even result in the tool becoming stuck in the borehole.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness, The example packer assembly described herein may be used to sample fluids in a subterranean formation. The example formation interfaces described herein may have an inflatable inner packer and an outer bladder for expanding in and/or engaging with walls in a wellbore. The packer assembly may have several components for reinforcing and/or stabilizing the expansion of the inner packer and/or the outer bladder.

Figure 1:
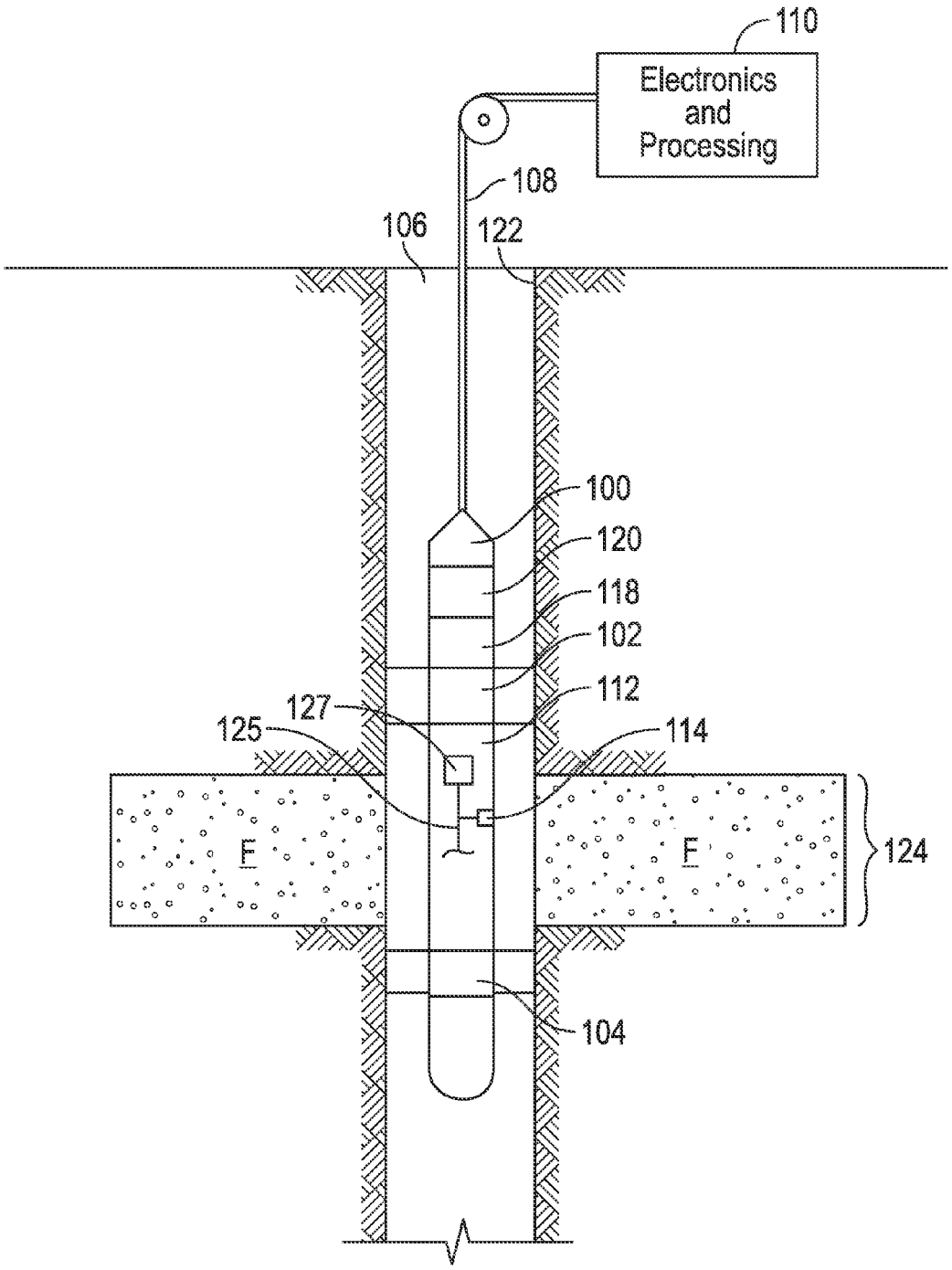
FIG. 1 (Prior Art)
FIG. 1 depicts an example of a downhole tool employing known inflatable packer assemblies.

Referring now to the drawings wherein like numerals refer to like parts, FIG. 1 depicts an example of a downhole tool 100 employing known inflatable packer assemblies 102, 104. The example downhole tool 100 is depicted as being deployed (e.g., lowered) into a wellbore or borehole 106 to sample a fluid from a subterranean formation F. The downhole tool 100 is depicted as a wireline type tool that may be lowered into the borehole 106 via a cable 108. The cable 108 bears the weight of the downhole tool 100 and may include electrical wires or additional cables to convey power, control signals, information carrying signals, etc. between the tool 100 and an electronics and processing unit 110 on the surface adjacent to the borehole 106. While the example downhole tool 100 is depicted as being deployed in the borehole 106 as a wireline device, the tool 100 may alternatively or additionally be deployed in a drill string, using coiled tubing, or by any other known method of deploying a tool into a borehole.

The downhole tool 100 includes a sampling module 112 having a sampling inlet 114. The sampling module 112 may further include an extendable probe (not shown) associated with the inlet 114 and an extendable anchoring member (not shown) to anchor the tool 100 and the probe in position to contact the formation F. The inlet 114, as shown, is a single inlet. However, a second or additional inlets (not shown) may operate in conjunction with the inlet 114 to facilitate dual inlet (i.e., guard) sampling. To extract borehole fluid from the area to be isolated by one or both of the packers 102, 104, the tool 100 includes a pumping module 118. The pumping module 118 may include one or more pumps, hydraulic motors, electric motors, valves, bowlines, etc. to enable borehole fluid to be removed from a selected area of the borehole 106.

To convey power, communication signals, control signals, etc. between the surface (e.g., to/from the electronics and processing unit 110) and among the various sections or modules composing the downhole tool 100, the tool 100 includes an electronics module 120. The electronics module 120 may, for example, be used to control the operation of the pumping module 118 in conjunction with operation of the packers 102, 104. For example, the packers 102, 104 may be used to hydraulically isolate a portion of the borehole 106 to facilitate sampling or testing a portion of the formation F.

In operation, the downhole tool 100 may be lowered via the cable 108 into the borehole 106 to a depth that aligns the sampling module 112 and, particularly, the sampling inlet 114, with a portion of the formation F to be sampled. The pumping module 118 may then be used to pump pressurized borehole fluid into the packers 102, 104 to inflate the packers 102, 104 so that the outer circumferential surfaces of the packers 102, 104 sealingly engage a wall 122 of the borehole 106. With the packers 102, 104 inflated, an area or section 124 of the borehole 106 between the packers 102, 104 is hydraulically isolated from the remainder of the borehole 106. The area 124 may be referred to as the interval, and the fluid contained therein may be at an interval pressure. The pumping module 118 is then used (e g., controlled by the electronics module 120 and/or the electronics and processing unit 110) to pump borehole fluid from the area 124 of the borehole 106. The pumping module 118 is then used to pump formation fluid from the formation F via the inlet 114 and a flowline 125 into a sample chamber 127 within the tool 100. The sample chamber 127 may not be located in the sampling module 112 as shown but may, for example, located in its own sample module (not shown).

Following collection of a sample, the pressurized fluid within the packers 102, 104 is released (e.g., by the pumping module 118) into the borehole 106 outside of the area 124. However, even if the packers 102, 104 are deflated or the pressurized fluid within the packers 102, 104 is released, the packers 102, 104 may maintain a relatively large outer diameter (i.e., not fully contract to their pre-inflation diameters), particularly if the borehole 106 has a relatively high temperature. If the outer diameter of one or both of the packers 102, 104 is not reduced to less than the minimum diameter of the borehole 106, then withdrawal of the tool 100 from the borehole 106 may be difficult or impossible without significant damage to the tool 100 and/or the borehole 106.

Figure 2:
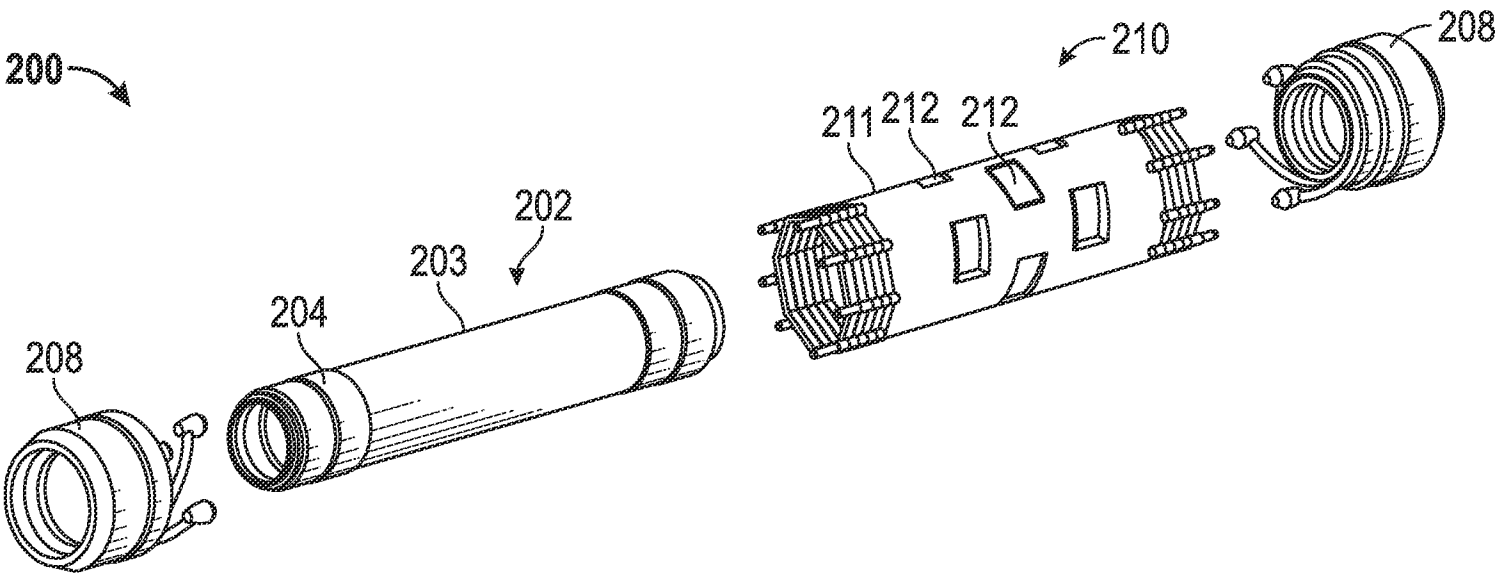
FIG. 2 is a perspective view of an inflatable packer assembly in accordance with one or more aspects of the present disclosure.

FIG. 2 is an exploded view of an inflatable packer assembly 200 that may be used to implement the packer assemblies 102, 104 shown in FIG. 1. The inflatable packer assembly 200 may have a flexible inflation packer element 202. The inflation packer element 202 may have an elastomeric material to form an inflatable bladder 203 that is coupled to a tubular end piece or mandrel 204 to define a cavity. The cavity may be filled with pressurized borehole fluid to cause the packer element 202 to expand and/or press against an outer bladder 210. The outer bladder 210 may be caused to expand and sealingly engage the borehole wall. The outer bladder 210 also may have an elastomeric material to form an outer layer 211 thereof. The outer bladder 210 may include reinforcing cables or slats (not shown) to strengthen the outer bladder 210 and to facilitate the return of the outer bladder 210 to its original i.e.(pre-inflation) shape. As may be seen in FIG. 2, the packer assembly 200 has ends 208 that may be coupled to the inflation packer 202 and/or the outer bladder 210. The ends 208 may engage a tool, such as the tool 100 shown in FIG. 1. The outer bladder 210 may have drains 212 located on the outer layer 211 , The drains 212 collect sample fluid from the formation when the outer bladder 210 is expanded against the wall or the formation. The shape of the drains 212 may protect the elastomeric outer layer 213 against extrusion.

Figure 3:
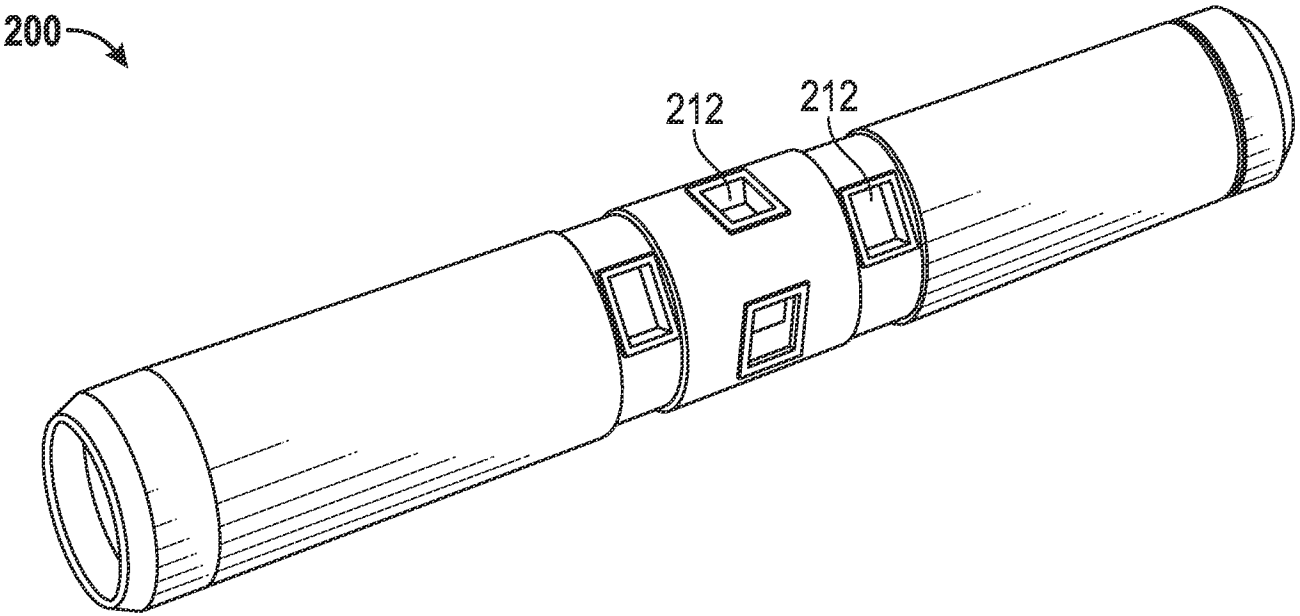
FIG. 3 is an exploded view of an inflatable packer assembly in accordance with one or more aspects of the present disclosure.

FIG. 3 is a perspective view of the packer assembly 200 of FIG. 2. As shown in FIG. 2, the inflatable packer 202 may be disposed within the outer bladder 210. The ends 208 seal the packer assembly 200. The ends 208 may be coupled to and/or may be in fluid communication with the outer bladder 210. More specifically, the ends 208 may be in fluid communication with the drains 212 of the outer bladder 210.

Figure 4:
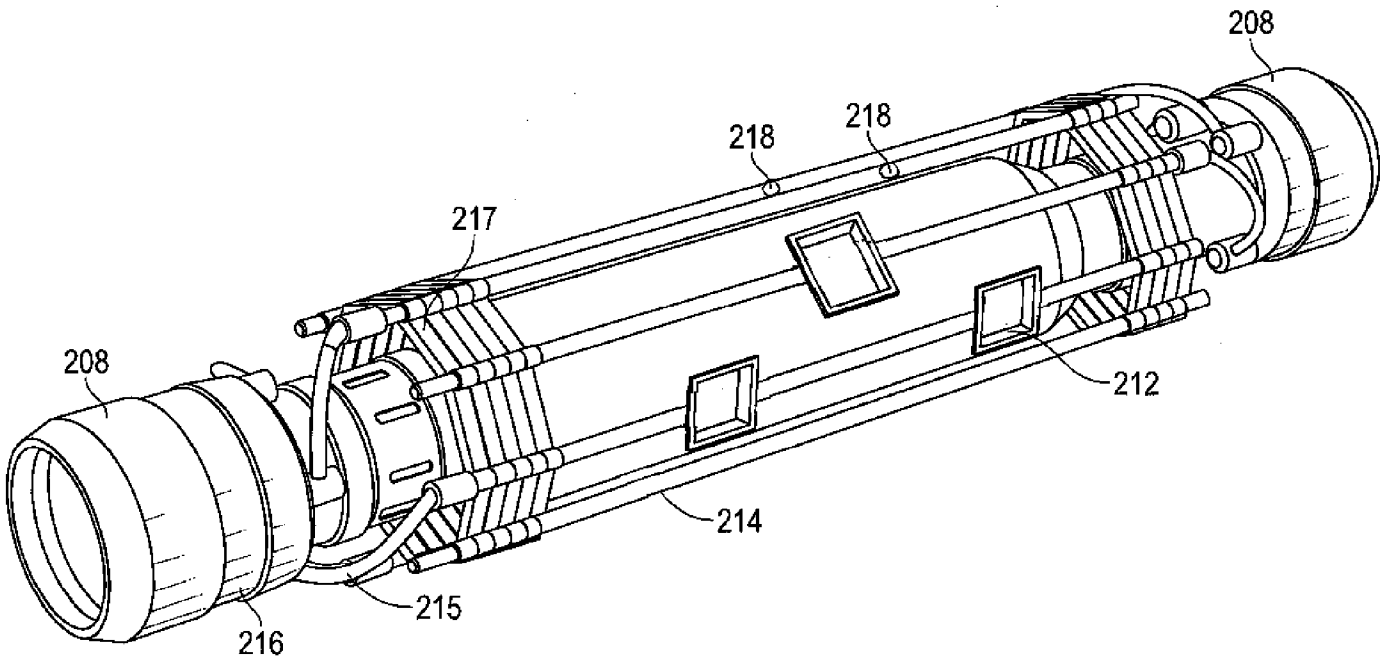
FIG. 4 is a partial cut away view of the packer assembly shown in FIG. 3.

FIG 4 is a partial cut away view of the packer assembly 200 shown in FIG. 3 with the outer layer 211 removed. As in FIG. 4, flowlines 214 may extend longitudinally along the length of the packer assembly 200. The flowlines 214 may be disposed in the outer layer 211 or underneath the outer layer 213. The flowlines 214 carry sampled fluid towards the ends 208. Rotating tubes 215 are connected with the ends of the flowlines 214. The rotating tubes 215 carry the sample fluid to collectors 216 at or near the ends 208 of the packer assembly 200. From the collectors 216, the sample may be directed inside the sampling tool, for in-situ analysis and/or storage inside bottles (not shown) for post-job analysis.

When sampling, the packer assembly 200 may be inflated by well fluid injected inside the inner inflatable packer 203 by a pump (not shown). The pump may be, for example, a modular formation dynamics tester ("MDT") pump. The inner inflatable packer 203 expands the outer rubber layer until the outer rubber layer seals against the formation. The outer bladder 210 may expand to seal against the formation. The sealing during sampling is facilitated by the elastomeric outer layer 211 of the packer assembly 200. The type of elastomeric material used for the outer layer 211 may be, for example, rubber. Sampling is carried out by reducing pressure inside the flowlines 214. The reduced pressure within the flowlines 214 draws fluid from the formation through the drains 212. This type of sampling involving a reduction of pressure within the sampling tool is called drawdown testing.

During sampling, an inflation volume and/or a deflation volume of the packer assembly 200 may be monitored. The inflation volume and/or the deflation volume may be controlled by a volumetric pump (not shown). The monitoring may help to control the sampling operation by detecting certain changes and/or events, For example, a leak in the packer assembly 200 may be detected. Another example may be detection of a larger than expected borehole diameter. Further, it may be possible to optimize the inflation/deflation cycles of the packer assembly 200. Controlling these cycles may ensure better longevity of the packer assembly 200 by optimizing deflation volumes between stations.

Monitoring may also speed up operation because an operator and/or control software may have a better estimation of inflation volume needed at every station, and the pump may be used at maximum speed with better control and low risk of damaging the packer assembly 200 by over-inflation.

Referring still to FIG. 4, springs 217 may be provided to reinforce the flowlines 214 and/or the outer bladder 210. When the outer bladder 210 is expanded, the springs 217 may also act to retract the outer bladder 210 to its original shape. Moreover, when the outer bladder 210 is expanded, the rotating tubes 215 may rotate and/or bend to maintain a connection with the flowlines 214. Articulations 218 may be provided on the flowlines 214. The articulations 218 allow the flowlines 214 to bend and/or deform when the outer bladder 210 is expanded. Each of the articulations 218 may be a pivoted joint which allows the flowline 214 to be redirected without inhibiting the flow.

Figure 5:
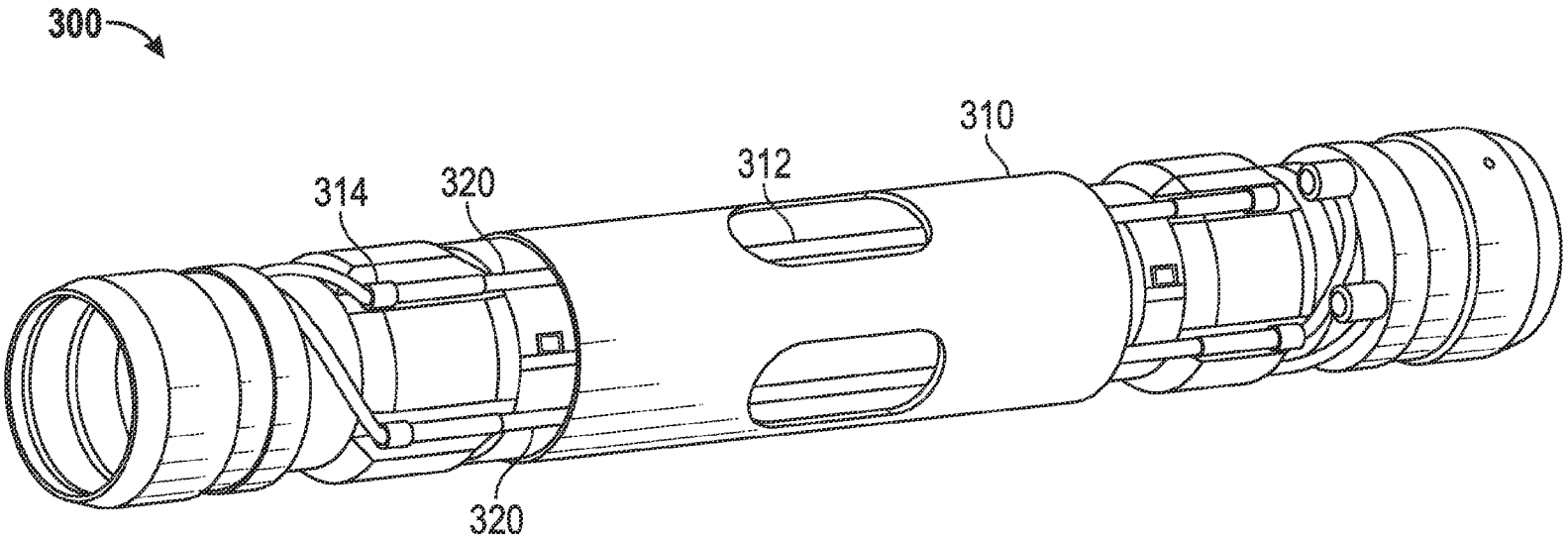
FIG. 5 is a perspective view of an alternative embodiment of a packer assembly in accordance with one or more aspects of the present disclosure.

FIG. 5 is a perspective view of an alternative embodiment of a packer assembly 300. The packer assembly 300 may have a piston ring 320 instead of springs to control the expansion of the outer bladder 210. The packer assembly 300 may also have larger drains 312 for use on a larger sampling surface of a formation wall. The drains 312 may be articulated; that is, the drains 312 may be pivoted and/or bent to conform to a formation wall.

Figure 6A:
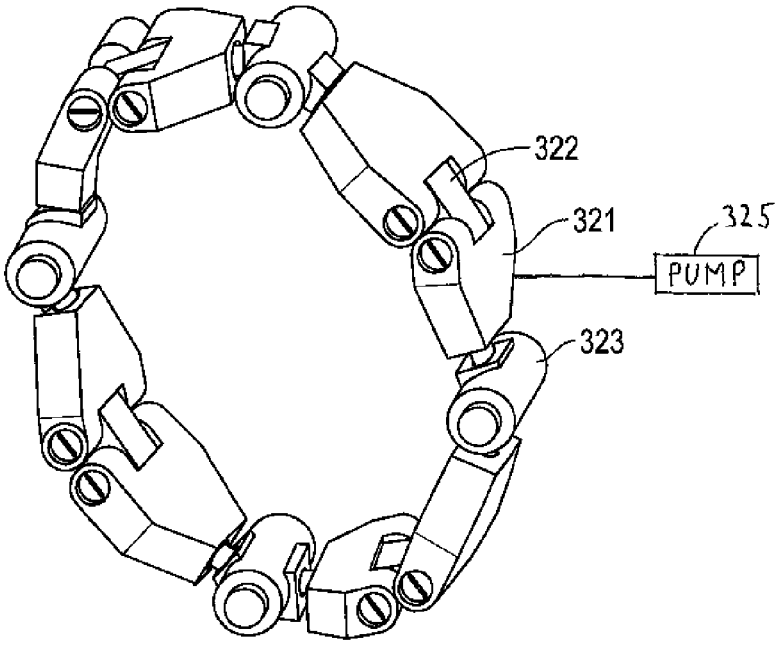
FIG. 6A and FIG. 6B are perspective views of a piston ring in a retracted and an expanded state in accordance with one or more aspects of the present disclosure.
Figure 6B:
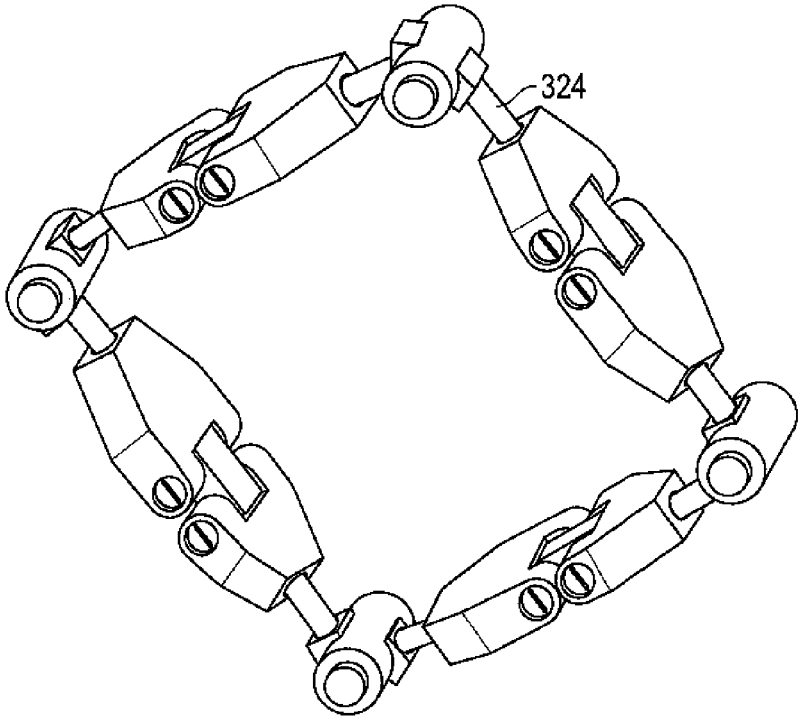

FIG. 6A and FIG. 6B are perspective views of the piston ring 320 in a retracted and an expanded state, respectively. The piston ring 320 may have passive pistons 321. The passive pistons 321 may have a vacuum chamber which resists expansion of the piston 321. Two pistons may be coupled together by a pivot joint 322. The piston ring 320 may also have a flowline fixture 323 for cradling the flowlines 314.

FIG. 6A shows the piston ring 320 in a contracted state. Upon expansion of the outer bladder 310, the piston ring 320 is forced to expand. FIG. 6B shows the piston ring 320 in an expanded state. When expanded, the flowlines 314 are drawn away from the packer assembly 300. The displacement of the flowlines 314 may cause the piston ring 320 to expand. Piston rods 324 of the pistons 321 are drawn from the chamber causing the length of the piston 321 to increase. When in the expanded position, the piston ring 320 may be under a constant retraction pressure due to the force of the individual pistons 321. The vacuum chamber may create a spring-like elastic force that pulls the rod 324 towards the piston 321.

In another embodiment, the pistons 321 of the piston ring 320 may be bi-directional. The pressure of the pistons 321 may be controlled by a pump 325. Thus, the pistons 321 may be extended and/or retracted on command. The adjusting of the direction of the piston 321 is governed by the injection of air and/or liquid into the chamber of the piston 321. When bi-directional pistons 321 are used, the extension and/or the retraction of the piston ring 320 may not be dependent on hydrostatic pressure. Furthermore, the control of the pistons 321 using the pump 325 may be used to expand the outer bladder 310 for sampling and/or sealing.

Figure 7:
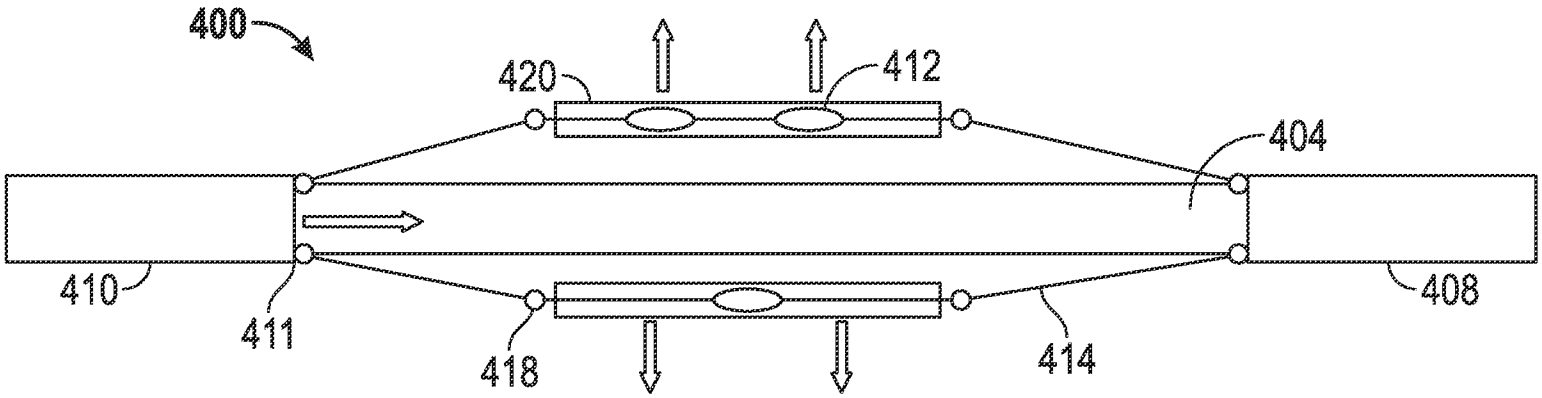
FIG. 7 is a top plan view of an alternative packer assembly in accordance with one or more aspects of the present disclosure.

FIG. 7 is a top plan view of an alternative packer assembly 400 in accordance with one or more aspects of the present disclosure. The inflatable packer assembly 400 includes a flexible packer element (e.g., an elastomeric material to form an inflatable bladder, tube, etc. removed for clarity of the other elements) that is coupled to a tubular body or mandrel 404 of a tool. The tool may be, for example, the tool 100 of FIG. 1. The packer element defines a cavity 406 that may be filled with pressurized borehole fluid to cause the packer element to sealingly engage a borehole wall, As is known, the packer element may include reinforcing cables, springs and/or slats (not shown) to strengthen the packer element and to facilitate the return of the packer element to its original (i.e., pre-inflation) shape. As may be seen in FIG. 7, a first end 208 is coupled to the packer element and is fixed in place (e.g., does not move relative to the body of the packer assembly 400). In contrast, a second end 410 has a sliding member 411 that slidingly engages the packer assembly 400. In this configuration, the sliding member 411 traverses toward the first end 408 during inflation of the packer element 402. The sliding of the second end 410 causes the outer bladder 420 to expand away from the packer assembly 400. Thus, the outer bladder 420 may expand until the drains 412 abut a borehole wall.

A motor and/or a hyrdraulic piston (not shown) may be used to move the second end 410 of the packer assembly 400. The motor and/or hydraulic piston may cause the flowlines 414 to move in accordance with the outer bladder 420. The flowlines 414 may have articulations or pivot joints 418 to facilitate freedom of movement under expanding conditions.

In another example embodiment, a downhole packer assembly is disclosed comprising: an outer bladder having a drain, an inflatable inner packer disposed within the outer bladder such that inflation of the inner packer causes the outer bladder to expand, end pieces coupled to the inner bladder and the outer bladder; and a flowline in fluid communication with the drain and the end pieces.

In one example embodiment, a method for sampling wellbore fluid is disclosed comprising providing a packer assembly having an inflatable inner packer within an outer bladder coupled between two end pieces wherein the outer bladder has a drain, positioning the packer assembly in a wellbore, inflating the inner packer until the outer bladder seals against walls of the wellbore and reducing a pressure inside the packer assembly to cause sample fluid to be drawn into the drain.

In another example embodiment, a system for sampling formation fluid in a wellbore is disclosed comprising: an inner packer having a first end and a second end wherein the inner packer has an inflatable exterior membrane; an outer bladder having a first end and a second end wherein the outer bladder surrounds the inner bladder further wherein the outer bladder has a drain that abuts a formation wall when the outer bladder expands; a first end piece and a second end piece connected to the first end and the second end of the outer bladder and the inner packer; a flowline in fluid communication with the drain; and a pump for pumping fluid from a reservoir of the wellbore into the inner packer.

Although example systems and methods are described in language specific to structural features and/or methodological acts, the subject matter defined in the appended claims is not necessarily limited to the specific features or acts described. Rather, the specific features and acts are disclosed as exemplary forms of implementing the claimed systems, methods, and structures.

What is claimed is:

1. A downhole packer assembly comprising:

an outer bladder having a drain;

an inflatable inner packer disposed within the outer bladder such that inflation of the inner packer causes the outer bladder to expand;

end pieces disposed near ends of the inner bladder and the outer bladder;

a flowline in fluid communication with the drain and the end pieces;

a piston ring in communication with the flowline, wherein the piston ring has a plurality of pistons connected to one another in a loop; and a plurality of pivot joints each coupling one of the pistons to an adjacent piston of the plurality of pistons, thereby forming the piston ring.

2. The downhole packer assembly of claim 1, further comprising:

a rotating tube connecting the flowline to the end pieces wherein the rotating tube rotates upon inflation of the inner packer.

3. The downhole packer assembly of claim 1, further comprising:

articulations in the flowlines.

4. The downhole packer assembly of claim 1, further comprising:

collectors in each of the end pieces for collecting a sample fluid via the flowlines.

5. The downhole packer assembly of claim 1, wherein at least one of the pistons comprises a vacuum chamber configured to resist expansion of the piston.

6. The downhole packer assembly of claim 5, wherein the at least one of the plurality of pistons comprises a piston rod, and the vacuum chamber is configured to create a spring-like elastic force to pull the rod towards the piston.

7. The downhole packer assembly of claim 1, further comprising:

a pump for controlling the movement of the pistons.

8. The downhole packer assembly of claim 1, further comprising:

a pumping module for pumping fluid into the inner packer to operate the packer assembly.

9. The downhole packer assembly of claim 1, wherein at least one of the plurality of pistons comprises a piston rod configured to be drawn from the piston to cause a length of the piston to increase.

10. A method for sampling wellbore fluid comprising:

providing a packer assembly having an inflatable inner packer within an outer bladder disposed between two end pieces wherein the outer bladder has a drain;

positioning the packer assembly in a wellbore;

inflating the inner packer until the outer bladder seals against walls of the wellbore;

reducing a pressure inside the packer assembly to cause sample fluid to be drawn into the drain; and controlling expansion of the outer bladder using a piston ring, wherein the piston ring has a plurality of pistons connected to one another in a loop and a plurality of pivot joints each coupling one of the pistons to an adjacent piston of the plurality of pistons, thereby forming the piston ring.

11. The method of claim 10, further comprising:

pumping the sample fluid through a flowline into collectors in the end pieces of the packer assembly using a pumping module.

12. The method of claim 11, wherein the flowline is extendable.

13. The method of claim 11, wherein the flowline is connected to the collectors using rotating tubes that rotate when the inner bladder in inflated.

14. The method of claim 10, further comprising:

deflating the inner packer to cause refraction of the outer bladder from the walls of the wellbore.

15. The method of claim 10, further comprising:

pumping fluid from the wellbore into the inner packer to inflate the inner packer using a pumping module.

16. A system for sampling formation fluid in a wellbore comprising:

an inner packer having a first end and a second end wherein the inner packer has an inflatable exterior membrane;

an outer bladder having a first end and a second end wherein the outer bladder surrounds the inner bladder, further wherein the outer bladder has a drain that abuts a formation wall when the outer bladder expands;

a first end piece and a second end piece disposed near the first end and the second end of the outer bladder and the inner packer;

a flowline in fluid communication with the drain;

a pumping module for pumping fluid from the wellbore into the inner packer to inflate the inner packer; and a piston ring in communication with the flowline, wherein the piston ring has a plurality of pistons connected to one another in a loop and a plurality of pivot joints each coupling one of the pistons to an adjacent piston of the plurality of pistons, thereby forming the piston ring.

17. The system of claim 16, wherein the pumping module dictates the volume of the inner packer.

18. The system of claim 16, wherein the outer bladder has an elastomeric outer layer wherein the flowline is embedded in the elastomeric outer layer and further wherein the drain is arranged along the elastomeric outer layer.

19. The system of claim 16, wherein the flowline is articulated to conform to the outer bladder upon expansion.

* * * * *